United States Patent [19]

Verbik

[11] Patent Number: 4,995,594

[45] Date of Patent: Feb. 26, 1991

[54] SLAG STOPPING PLUG FOR TAP HOLES OF METAL FURNACES CONTAINING MOLTEN MATERIAL

[75] Inventor: Robert M. Verbik, Merrillville, Ind.

[73] Assignee: MPC, Metal Process Control A.B., Nyköping, Sweden

[21] Appl. No.: 420,894

[22] Filed: Oct. 13, 1989

[51] Int. Cl.[5] ..... C21C 5/48

[52] U.S. Cl. ..... 266/272; 222/597

[58] Field of Search ..... 266/272, 45; 222/597, 222/590, 591; 266/271, 236

[56] References Cited

U.S. PATENT DOCUMENTS

| | | | |
|---|---|---|---|
| 3,124,854 | 3/1964 | Dore | 266/272 |
| 3,398,945 | 8/1968 | Walpole | 266/272 |
| 3,540,627 | 11/1970 | Armstead | 266/272 |
| 4,030,709 | 6/1977 | Shepard et al. | 266/45 |
| 4,471,950 | 9/1984 | Labate | 266/272 |
| 4,826,139 | 5/1989 | Van Es | 266/272 |
| 4,828,226 | 5/1989 | Komanecky | 266/45 |
| 4,877,221 | 10/1989 | Scriven | 266/272 |

FOREIGN PATENT DOCUMENTS 1515629 6/1978 United Kingdom .

OTHER PUBLICATIONS

Article: Tri-Star—Comprehensive System for Total Tap Slag Carryover Control, 1 pg. (undated).

*Primary Examiner*—S. Kastler

*Attorney, Agent, or Firm*—Burns, Doane, Swecker & Mathis

[57] ABSTRACT

A plug for temporarily closing a tap hole in a metal making furnace comprises a plug body insertable into the tap hole. The plug body comprises a ceramic blanket. A plurality of biasing springs are disposed inside the blanket and are held in a retracted condition by a heat-sensitive retaining band which extends around an outer periphery of the plug. A plurality of metal strips are disposed on an outer surface of the plug to protect the blanket. When the plug is inserted into a tap hole, the band is melted by the high temperatures therein, enabling the spring to expand the plug into contact with a surface of the tap hole.

17 Claims, 2 Drawing Sheets

SLAG STOPPING PLUG FOR TAP HOLES OF METAL FURNACES CONTAINING MOLTEN MATERIAL

BACKGROUND AND OBJECTS OF THE INVENTION

During the production of steel in a converter furnace, impurities referred to as "slag", float atop the molten metal. It is desirable to remove the molten metal from the furnace separately from as much of the slag as possible to minimize the amount of impurities within the metal. One conventional way of achieving that result is to tilt the furnace while plugging a tap hole of the furnace so as to block the exit of slag, and then unplugging the tap hole after at least most of the slag has passed thereover, whereby molten metal will be poured from the tap hole while the slag remains in the furnace.

It is desirable that the plug create an effective seal with the surface of the tap hole in order to minimize the leakage of slag past the plug. Also, it is desirable to install the plug deeply into the tap hole in order to minimize the amount of slag which can enter the tap hole. A plug must overcome certain formidable obstacles in order to achieve those goals.

One obstacle relates to the high temperatures present within the tap hole, e.g., temperatures which may exceed 3000° F., which restrict the types of materials which can be employed when forming the plug.

Another obstacle involves a non-uniform cross-sectional shape of the surface of the tap hole. That is, due to an uneven wear of that surface during the pouring of molten metal and/or a depositing of metal or slag on the surface, the surface of a well used tap hole can become highly irregular in cross-sectional size and shape. As a result, gaps tend to be formed between the plug and the tap hole surface, resulting in an appreciable leakage of slag during a tapping sequence.

Various techniques for plugging the tap hole have been proposed, see for example U.S. Pat. Nos. 3,124,854; 3,398,945; 3,540,627; 4,030,709; 4,471,950; and 4,826,139.

In U.S. Pat. No. 4,471,950 a blunt-nosed plug is formed of a ceramic material. A wedge disposed inside the plug can be pushed forwardly by a manual rod to expand the plug into engagement with the surface of the tap hole. It may be difficult to maneuver plugs of this type such that the plug is pushed deeply into the tap hole before being expanded. Furthermore, the plug provides no projection for the outer surface of the ceramic material. Any rubbing of that surface against the tap hole could result in damage to the ceramic material. In addition, the wedge is relatively short in length and thus may not impose sufficiently high forces to the rear end of the plug for effectively resisting the leakage of slag therepast.

In U.S. Pat. No. 4,826,139, a concrete plug is disclosed which can be installed deeply into the tap hole. This is made possible because the plug diameter is smaller than the diameter of the tap hole, i.e., a loose-fit exists. Bendable metal strips disposed behind the plug serve to engage the surface of the tap hole and resist outward movement of the plug until the metal strips have been softened by the heat of the molten metal during a tap sequence. It would be desirable, however, to create a better fit between the plug and the surface of the tap hole for more completely blocking the outflow of slag.

The remaining ones of the above-listed patents disclose pushing a frusto-conically shaped plug of steel or masonry into the tap hole. The cone is inserted at the end of a pole until coming to rest on the lip of the tap hole. Often, as the result of slag or steel build-up on the tap hole lip, there may be insufficient room in which to wedge the plug in place. Also, since the lip of the tap hole tends to wear and thus become enlarged after prolonged usage, it is usually necessary for the user to stock more than one plug size.

It has also been proposed to form a plug body of a special composition which, when heated to the high temperatures present in the tap hole, tends to expand into tighter contact with the tap hole surface. However, such plugs are relatively expensive.

SUMMARY OF THE INVENTION

The above-discussed shortcomings are eliminated or alleviated by the present invention which relates to a plug for temporarily closing a tap hole in a furnace containing molten material. The plug comprises a plug body insertable into a tap hole. A biasing structure is held in a retracted condition by a heat-sensitive retaining member during insertion of the plug into the tap hole. The biasing structure is releasable in response to thermal destruction of the heat-sensitive retaining member for expanding the plug body against a surface of the tap hole.

Preferably, the plug body comprises a heat-resistant ceramic blanket. The biasing structure preferably comprises a series of strips of spring steel which are bent and retained by the retaining member. The retaining member preferably comprises a heat-sensitive band extending around the outer periphery of the plug.

Preferably, a series of strips of metal are disposed around the outer surface of the plug to protect the heat-resistant blanket material from damage as could result from contact of that relatively fragile material with the surface of the tap hole.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 3:
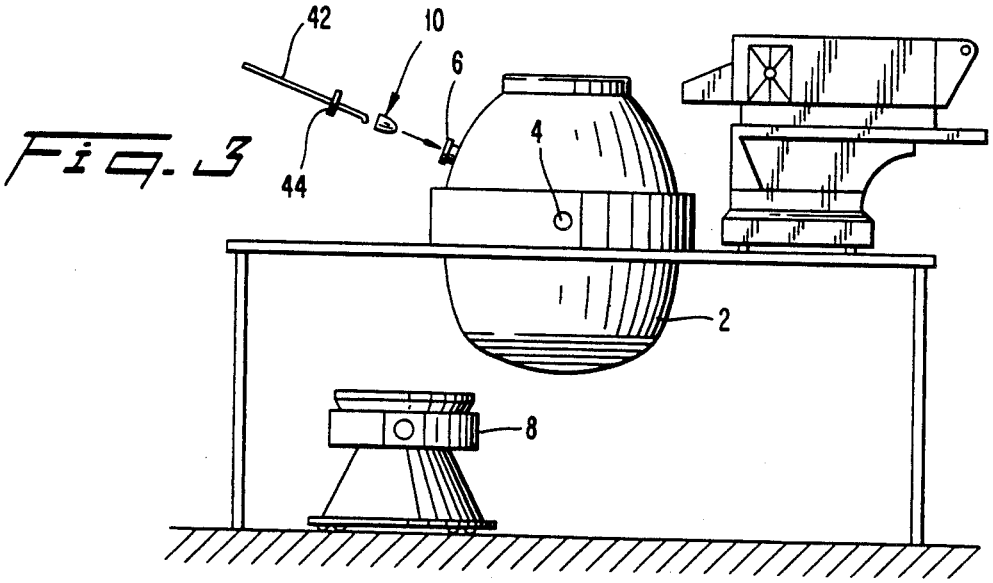
FIG. 3 is a schematic side elevational view of an oxygen furnace used in a steel making operation.

Depicted schematically in FIG. 3 is a conventional vessel 2 for containing molten metal, such as a basic oxygen furnace used in steel making. The vessel 2 is mounted so as to be pivotable about a horizontal trunion pin 4. Formed in a side wall of the vessel adjacent an upper end thereof is a tap hole 6 which enables molten steel to be poured from the vessel into a ladle 8 when the vessel is rotated about the pin 4. During the initial stage of rotation, impurities, or slag, floating atop the molten steel will, unless blocked, pass through the tap hole and into the ladle 8, thereby becoming mixed with and contaminating the later-exiting molten steel.

In accordance with the present invention, a plug 10 is installed in the tap hole in order to resist the entry of slag into the tap hole, thereby minimizing the extent of contamination of the molten metal.

Figure 1:
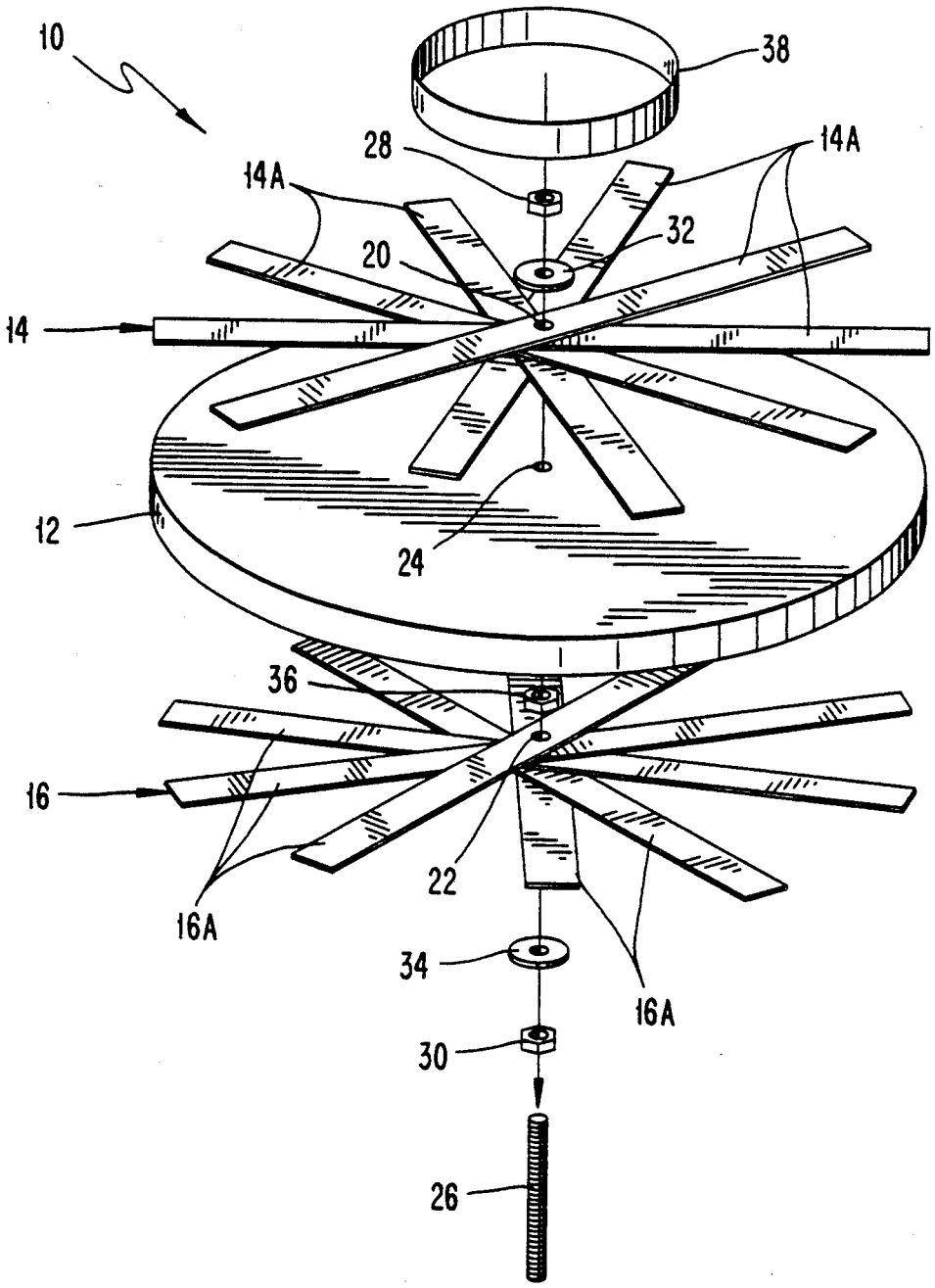
FIG. 1 is an exploded perspective view of the components of a plug according to the present invention prior to the components being assembled.
Figure 2:
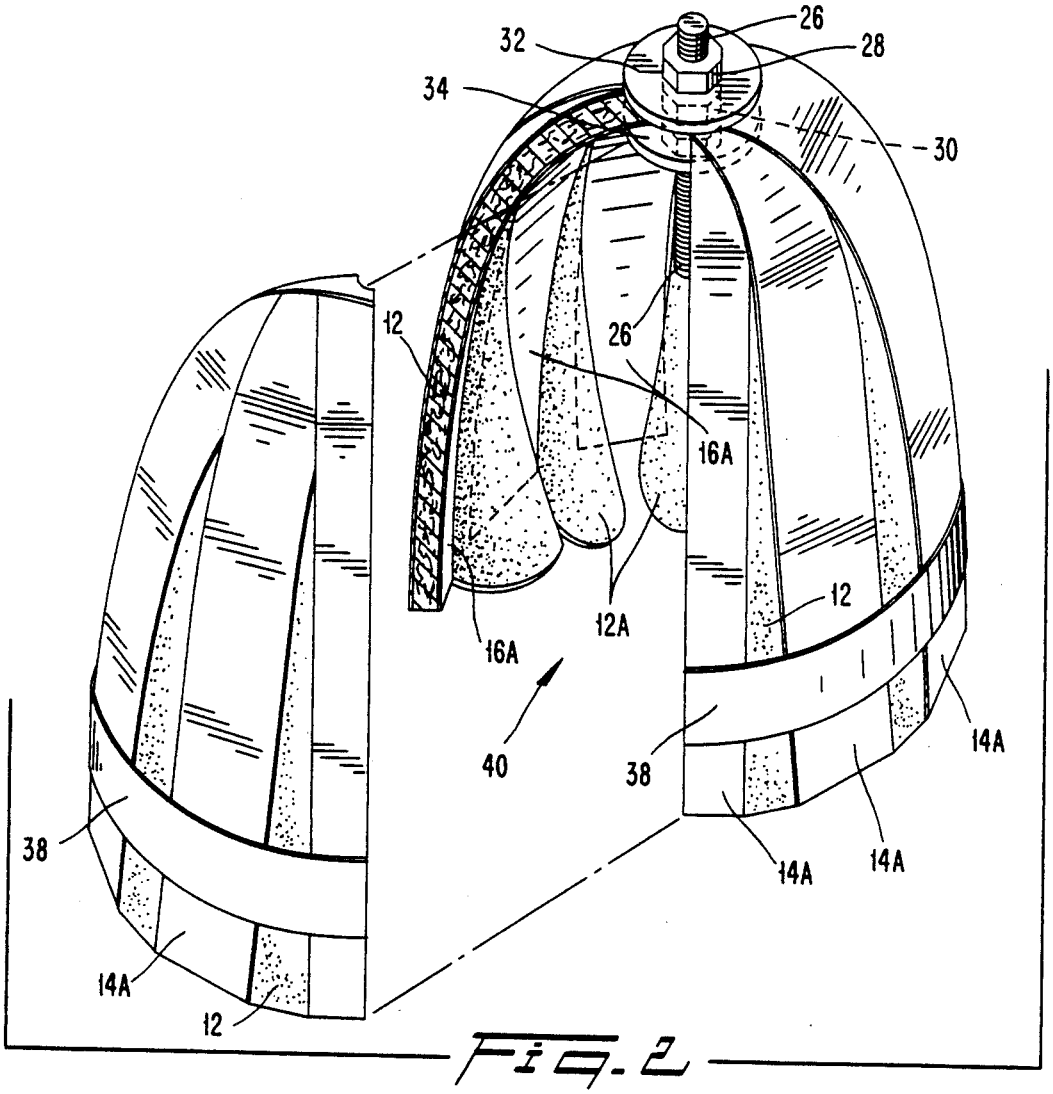
FIG. 2 is a perspective exploded view of the plug after the components have been assembled.

A plug 10 according to the present invention is shown in FIG. 1 before being assembled and shown in FIG. 2 after having been assembled. The plug comprises a plug element in the form of a layer 12 of heat-resistant material such as a conventional blanket of ceramic fiber or felt which exhibits very low thermal conductivity.

The heat-resistant blanket 12 is sandwiched between outer and inner support layers 14, 16. As will be hereinafter explained, the inner layer functions to actuate or expand the plug, while the outer layer functions to protect the ceramic blanket. The outer and inner layers 14, 16 are of identical construction, each comprising a stack of elongated strips or ribs 14A, 16A formed of spring steel. The strips of each stack are angularly offset by equal angles from one another. In the disclosed preferred embodiment each stack comprises five strips spaced apart by 36 degrees.

The strips in the outer layer 14 are angularly offset from the strips of the inner layer 16, e.g., offset by 18 degrees in the disclosed preferred embodiment.

The strips 14A, 16A and the heat-resistant blanket 12 have center apertures 20, 22, 24 which are alignable to receive a threaded stud 26. The stud is secured in place by outer and inner nuts 28, 30 which engage outer and inner washers 32, 34, as well as by an intermediate nut 36 disposed between the heat-resistant blanket 12 and the inner support layer 16.

Since the strips 14A, 16A are formed of an elastic material, such as spring steel, the unit comprised of the three layers 12, 14, 16 can be folded in a suitable jig to form a blunt-nosed plug of hollow frusto-conical or bullet-shaped geometry (see FIG. 2). To retain the layers in that geometry, a circular retainer band 38 is installed around the outer circumference of the plug near the rear end thereof.

The band is formed of a heat-sensitive material such as plastic, copper, zinc, and the like, so as to be destructible under the influence of the higher temperatures existing within the tap hole near the inside of the vessel. Upon such destruction of the band, it will be appreciated that the inner layer of strips will spring out toward their original shape to expand the plug.

In operation, the plug 10 is formed by folding the layers 12, 14, 16 into a hollow bullet shape and applying the retainer band 38. A rear end of the stud 26 is exposed within the hollow interior cavity 40 of the thus-formed plug.

The plug is preferably installed immediately prior to the tapping step, in order to minimize the period to which the plug is subjected to the high temperature of the tap hole.

If desired, the vessel can be slagged-off prior to the tapping step, and prior to the insertion of the plug. To install the plug, the plug is placed upon the end of an installation pipe 42 (see FIG. 3) by inserting the rear end of the stud into a hollow front end of the pipe 42. The plug is held to the pipe with the aid of the heat-resistant blanket 12 which will have become bunched up within the cavity 40 when the layers 12, 14, 16 were folded into the bullet shape. That is, the bunched-up blanket 12 envelops the outer periphery of the pipe to retain the plug on the pipe.

An operator then manipulates the pipe to insert the plug 10 straight into the tap hole 6. Preferably, the plug is inserted deeply into the tap hole in order to minimize the amount of slag which can enter the tap hole during a tap sequence. Also, a deeply inserted plug will be less susceptible to being pushed out of the tap hole prematurely under the weight of the slag, since slag cannot enter the tap hole.

To facilitate a deep insertion of the plug, the maximum diameter of the plug is designed to be less than the diameter of the tap hole. For example, a plug having a maximum diameter of six inches could be used in connection with a tap hole of eight inch diameter. Since the plug is expandable by the spring strips 16A, the plug can be used in connection with a variety of tap hole sizes. Even in the event that the mouth of the tap hole has been reduced by slag or steel build-up to a diameter less than that of the plug, the plug can still be installed by applying sufficient pushing force to cause the plug to be further retracted or reduced in diameter as it travels along the tap hole. It will be appreciated that the pushing forces are directed forwardly at the center of the layers 12, 14, 16 to promote such retraction of the plug.

During insertion of the plug, no significant contact between the ceramic blanket and the surface of the tap hole will occur, because the outer strips 14A will abut against the tap hole surface and prevent the blanket from making contact with that surface in a manner which could cause tearing of the blanket.

Preferably, the pipe 42 contains an adjustable stop flange 44 which is set at a predetermined distance from the front end of the pipe. The stop flange engages the mouth of the tap hole to limit the extent to which the pipe, and thus the plug, can be installed. This ensures a constant depth of plug insertion.

The temperature in the tap hole increases as the vessel interior is approached. Eventually, the plug will encounter sufficiently high temperatures to melt the retainer band 38. The band 38 can be formed of a material which melts upon reaching any chosen temperature which is greater than the temperature at the mouth of the tap hole and not greater than the maximum temperature in the tap hole. When the retainer band melts, the inner layer of strips 16 tend to spring out toward their original straight shapes, thus forcing the outer surface of the plug against the wall of the tap hole.

Even if the band melts before the plug has been fully inserted, the plug can be inserted farther into the tap hole (i.e., until the stop flange 44 contacts the mouth of the tap hole) since the strips 14A, 16A are yieldable inwardly to by-pass obstructions, and the ceramic blanket is protected from being ripped by the tap hole surface, due to the presence of the outer strips 14A. That is, the inner strips tend to push the blanket against the tap hole surface, but the force with which that occurs is limited by the presence of the outer strips. Hence, the blanket will not be excessively ripped as it slides along the tap hole surface, and yet will be able to create an obstruction to slag flow once in its final position.

Since the inner strips 16A extend substantially the entire length of the plug, outward forces will be applied even at the rearmost end of the plug to resist leakage.

When the tap sequence is initiated, the entry of appreciable amounts of slag into the tap hole will be blocked by the plug. After the vessel 2 has been sufficiently tilted, the slag will become disposed at a level above the tap hole, and the plug will come under the influence of heat and pressure of the molten metal. Eventually, the strips 14A, 14B will be melted by the intense heat, enabling the ceramic blanket to be pushed out of the tap hole by the molten metal.

During the period following the insertion of the plug and before the slag has reached an elevation above the tap hole during the tap sequence, the inner strips 16A are shielded from the high temperature within the tap hole by the ceramic blanket which, due to the blanket being bunched up, envelops the inner strips.

It will be appreciated that the plug according to the present invention is readily capable of being inserted deeply into a tap hole and can be adapted to tap holes of different cross-sectional shapes and sizes. Due to the flexible strips, the plug can bypass obstacles which would block conventional plugs. Furthermore, installation of the plug can be carried out in the usual manner, requiring no retraining of the operator. No manipulation of the installation pipe or any other element is needed in order to expand the plug; such expansion will occur automatically upon a melting of the destructible band. Outward forces will be applied along substantially the entire length of the plug to effectively push the rear end of the plug against the surface of the tap hole.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A plug for temporarily closing a tap hole in a furnace containing molten material, comprising a plug element insertable into a tap hole, biasing means held in a retracted condition by a heat-destructible retaining member during insertion of the plug into the tap hole, said heat-destructible material being destructible by a temperature encountered in the tap hole, said biasing means being releasable in response to thermal destruction of said retaining member for urging said plug element against a surface of the tap hole.

2. A plug according to claim 1, wherein said plug element is formed of a ceramic fiber.

3. A plug according to claim 2 including a protective layer disposed to the outside of said plug element for protecting the latter during insertion of the plug into the tap hole.

4. A plug according to claim 3, wherein said protective layer comprises a plurality of longitudinally extending strips.

5. A plug according to claim 1, wherein said biasing means comprises a plurality of springs.

6. A plug according to claim 5, wherein each of said springs comprises a longitudinally extending strip-shaped leaf spring.

7. A plug according to claim 5, wherein said plug element is of hollow bullet shape, said spring means disposed within a hollow interior formed by said element.

8. A plug according to claim 1, wherein said plug element comprises a blanket which envelops said spring means to shield said spring means against the temperature within the tap hole.

9. A plug according to claim 1, wherein said retaining member comprises a band extending around the exterior of said plug element.

10. A plug for temporarily closing a tap hole in a metal-making furnace, comprising:

a plug element arranged in a generally hollow bullet shape with a hollow interior and presenting a first maximum cross-section;

a plurality of leaf springs disposed in said hollow interior and urging said plug element outwardly toward a generally frusto-conical shape having a larger maximum cross-section than said first maximum cross-section; and a heat-destructible retaining band disposed to the outside of said leaf springs for opposing said leaf springs to permit said plug to be inserted into the tap hole, said heat-destructible band being formed of a material which is destructible by a temperature within the tap hole to enable said springs to urge said plug element outwardly against a surface of the tap hole, said material of said band being less heat-resistant than a material of which said plug element is formed.

11. A plug according to claim 10, wherein said plug element comprises a ceramic blanket, a plurality of additional lead to the outside of said plug element and being staggered with respect to said first-named leaf springs.

12. A plug according to claim 10, wherein said plug element comprises a blanket which envelops said leaf springs to shield said leaf springs from the temperature within the tap hole.

13. A plug for temporarily closing a tap hole in a furnace containing molten material, comprising:

a plug element forming a generally frusto-conical shape with a hollow interior, spring means disposed in said hollow interior for urging said plug element outwardly into an expanded shape, and retaining means for opposing said spring means to enable the plug to be inserted into a tap hole, said retaining means being releasable after the plug has been inserted into the tap hole to enable said spring means to expand said plug element outwardly into engagement with a surface of the tap hole.

14. A plug according to claim 13, wherein said retaining means is destructible by temperatures encountered in the tap hole.

15. A plug according to claim 13, wherein said retaining means comprises a band extending around said plug element, said band being releasable in response to insertion of said plug into the tap hole.

16. A plug according to claim 13 including protective members disposed on an outside surface of said plug element to limit contact between said plug element and a surface of said tap hole during insertion of the plug thereinto.

17. A plug according to claim 15, wherein said spring means comprises a plurality of circumferentially distributed spring strips disposed in said hollow interior.

* * * * *